US009499968B2

(12) United States Patent
Mukerji

(10) Patent No.: US 9,499,968 B2
(45) Date of Patent: Nov. 22, 2016

(54) KINETIC TRAPWAY

(75) Inventor: Sudip Mukerji, Cedarburg, WI (US)

(73) Assignee: KOHLER CO., Kohler, WI (US)

( * ) Notice: Subject to any disclaimer, the term of this patent is extended or adjusted under 35 U.S.C. 154(b) by 1495 days.

(21) Appl. No.: 12/163,269

(22) Filed: Jun. 27, 2008

(65) Prior Publication Data

US 2009/0320200 A1 Dec. 31, 2009

(51) Int. Cl.
*E03D 11/10* (2006.01)

(52) U.S. Cl.
CPC ..... *E03D 11/10* (2013.01)

(58) Field of Classification Search
CPC ..... E03D 11/10
USPC ..... 4/434, 435, 438, 441
See application file for complete search history.

(56) References Cited

U.S. PATENT DOCUMENTS

| | | | | |
|---|---|---|---|---|
| 270,211 | A | 1/1883 | Farthing | |
| 2,678,450 | A | 5/1954 | Simpson et al. | |
| 2,817,092 | A | 12/1957 | Hahn | |
| 3,302,216 | A | 2/1967 | Fulton et al. | |
| 3,458,873 | A * | 8/1969 | Delin | A47K 11/023 219/217 |
| 3,521,305 | A | 7/1970 | Fulton et al. | |
| 3,585,650 | A | 6/1971 | Lekberg et al. | |
| 3,769,637 | A * | 11/1973 | Llames | E03D 5/04 4/436 |
| 3,922,729 | A | 12/1975 | Ashley | |
| 4,028,746 | A | 6/1977 | Huck | |
| 4,947,492 | A * | 8/1990 | Vincent | 4/420 |
| 5,446,928 | A | 9/1995 | Daniels | |
| 6,195,810 | B1 | 3/2001 | Minamiyama et al. | |
| 6,434,759 | B1 * | 8/2002 | Pondelick et al. | 4/246.2 |
| 6,467,101 | B1 | 10/2002 | Artola | |
| 2001/0049841 | A1 | 12/2001 | Lee | |
| 2001/0052147 | A1 | 12/2001 | Lee | |
| 2002/0112283 | A1 | 8/2002 | Jansen | |
| 2002/0124302 | A1 | 9/2002 | Jansen | |
| 2007/0094783 | A1 | 5/2007 | Wen | |

FOREIGN PATENT DOCUMENTS

| | | |
|---|---|---|
| KR | 10/425419 | 3/2004 |
| WO | WO 03/0710441 A1 | 8/2003 |
| WO | WO2008/032989 | 3/2008 |

OTHER PUBLICATIONS 6 pages of a PCT search report dated Mar. 15, 2010 in a corresponding application PCT/US2009/003755.

* cited by examiner

*Primary Examiner* — Janie Loeppke
(74) *Attorney, Agent, or Firm* — Foley & Lardner LLP

(57) ABSTRACT

The present invention provides toilets having an outlet trapway that is movable during a flushing cycle. A toilet bowl has an opening adjacent its lower end. A conduit links to the opening so as to be able to swivel between a first upwardly directed position which forms a trap for the toilet, and a second less upwardly directed position which can be reached during the flushing cycle to facilitate evacuation of the toilet bowl. An actuator moves the conduit between the first and second positions during the flushing cycle in response to a condition of a water supply for the toilet, preferably without using electrical power to achieve this trapway movement.

21 Claims, 7 Drawing Sheets

KINETIC TRAPWAY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to toilets. More particularly it relates to toilets having moveable trapways to facilitate bowl evacuation with reduced water usage.

Conventional toilets typically have a bowl portion connected to a trapway. One such prior art toilet 10 is shown in FIG. 1 of this application. A trapway 12 extends from a bowl 14 to an outlet 16. In conventional fashion the trapway 12 slopes upwardly as it extends away from the bowl opening 18 such that the trapway 12 forms a weir or water dam 20. The weir 20 prevents downstream sewer gases from returning to the toilet. This is because when the toilet 10 is not in use the water level will be as shown as in the dotted lines, thereby preventing gases from returning from the outlet 16 back to the bathroom.

When the toilet is flushed by adding more water to the bowl, as is well known in the art, the configuration of the weir 20, the down leg 22, the elbow 24, and the out leg 26, induces the formation of a siphon that assists the evacuation of water and waste from the bowl 14. The trapway 12 then transports the waste to the outlet 16 and an attached sewer line.

However, a structure that promotes the formation of a siphon requires some design compromises. For example, the smaller the cross section of the trap, the easier it is to form the siphon. On the other hand, small cross section traps may be susceptible to clogging, and in any event at the extreme may violate plumbing codes.

Further, toilets which rely on siphons can "waste" at least some water to develop the siphon. This can be problematic given the regulatory restrictions on using more than 6.06 liters per flush, and given the market preference for even more "green friendly" toilets.

Achieving an effective flush, while using so little water, can be difficult. A variety of different approaches have been tried (e.g. pressurizing the water; using jets). However, each known approach has its disadvantages. For example, some approaches add undesirable costs. Others rely on systems that don't clean certain types of waste as effectively, leading consumers to flush twice or more.

Some approaches have tried to move the trapway during the flush cycle, while still relying on some form of siphon development. For example, U.S. Pat. No. 3,922,729 provides a toilet that initiates an emptying of bowl by lowering a dam made from a flexible material. However, this toilet still has a lower trapway portion for formation of a siphon and creation of a water seal.

Another approach is to move the trapway during the flush cycle, and not rely on a siphon. For example, U.S. Pat. No. 2,817,092 shows a portable commode with moveable components and does not require the formation of a siphon. However, the length of the flush cycle is variable and conditioned on the length of time that a handle is depressed by the user. Thus, the flush cycle is not readily reproducible, nor guaranteed to meet regulatory requirements restricting the amount of water used per flush cycle.

Likewise, U.S. Pat. No. 5,446,928 does not require the formation of a siphon. However, it does require the user to lift the entire seat and bowl of the toilet to straighten a tube trapway.

U.S. Pat. No. 6,195,810 has a flexible trapway that is controlled by an electric motor to position a moveable trapway for the elimination of waste from the bowl. However, such a trapway requires electrical power to operate the toilet regardless of the advantages this structure might otherwise have.

Other U.S. patent documents representative of the art with respect to moveable trapways include U.S. Pat. Nos. 270,211, 2,678,450, 3,302,216, 3,521,305, 3,585,650, 3,922,729, 4,028,746, 4,947,492 and 6,467,101, and U.S. patent application publications 2001/0049841, 2001/0052147, 2002/0112283 and 2002/0124302.

Accordingly, there is still a need for improved trapways, particularly those which permit efficient bowl cleaning with very low levels of water usage per flush.

SUMMARY OF THE INVENTION

The present invention provides a toilet having an outlet trapway that is movable during a flushing cycle. The toilet includes a toilet bowl, a conduit, and an actuator. The toilet bowl has an opening adjacent its lower end. The conduit links to the opening of the toilet bowl so as to be able to swivel between a first upwardly directed position and a second less upwardly directed position. The first upwardly directed position forms a trap for the toilet and the second less upwardly directed position can be reached during the flushing cycle to facilitate evacuation of the toilet bowl. The actuator moves the conduit between the first and second positions during the flushing cycle in response to a condition of a water supply for the toilet.

According to one aspect of the invention, the water supply may include a water tank, and the condition of the water supply is a level of water in the water tank. The actuator can include a float which follows the level of water in the water tank. The float can be mechanically linked to a downstream end of the conduit. The buoyancy of the float can hold the conduit in the first position when the water tank has a level of water that is at a normal fill level of the tank.

According to yet another aspect of the invention, the water supply may include a pressurized inlet line, and the condition of the water supply is whether or not water is entering the bowl from the pressurized inlet line. The actuator may include a piston linked to the conduit such that movement of the piston in response to the condition of the water supply can cause movement of the conduit between the first and second positions. The actuator may further include a spring that biases the conduit towards the first position. When the water passes from the pressurized line to the bowl it may create a suction or increased pressure zone to facilitate movement of the piston.

According to other aspects of this invention, there may be a flexible joint connecting the opening and the conduit. Further, the toilet may include an outlet stack positioned adjacent a downstream end of the conduit at least when the conduit is in the second position.

In other aspects of the invention the movement of the trapway may be achieved without requiring that an electrical power source be linked to the toilet.

The present invention provides a kinetic trapway that preferably does not require the formation of a siphon for operation. In this regard, the trap is pivoted down enough that gravity drives the trap sufficiently.

As the trapway does not require the formation of a siphon for operation, the diameter of the conduit can be somewhat larger than in a siphonic trapway, and the flush cycle can be somewhat shorter. This reduces the possibility of the toilet clogging during the flush cycle, and in some embodiments leads to less water usage.

These and still other advantages of the invention will be apparent from the detailed description and drawings. What follows is merely a description of preferred embodiments of the present invention. To assess the full scope of the invention the claims should be looked to as the preferred embodiments are not intended to be the only embodiments within the scope of the claims.

DETAILED DESCRIPTION OF THE PREFERRED EMBODIMENTS

Referring now to FIGS. 2-7, a toilet 100 is shown as being used with all three depicted embodiments. It has a bowl 102 supported by a base 104. A water supply provides water to the bowl 102 during a flushing cycle of the toilet 100.

Figure 1:
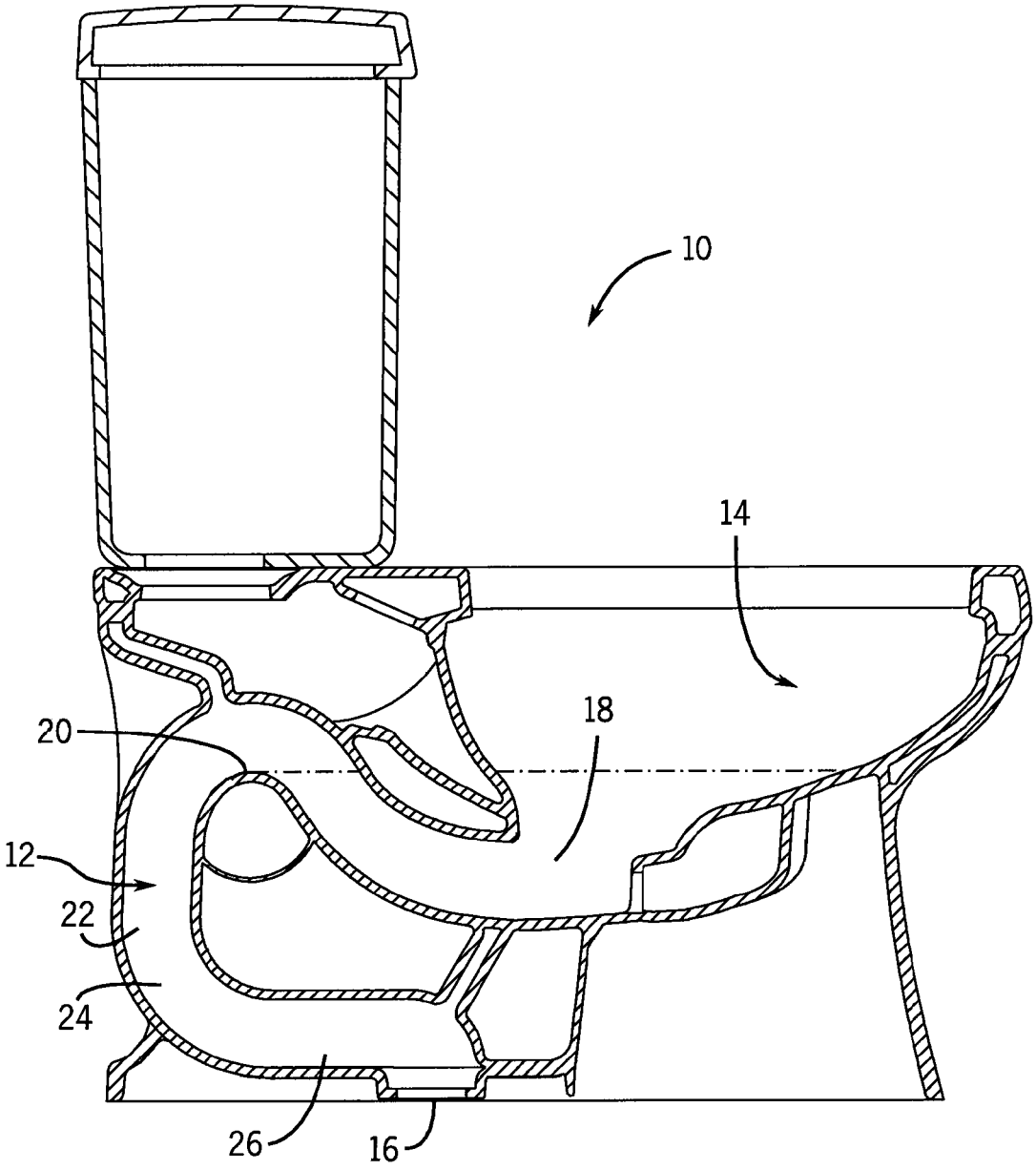
FIG. 1 PRIOR ART
FIG. 1 is a vertical cross-sectional view of a prior art toilet.
Figure 2:
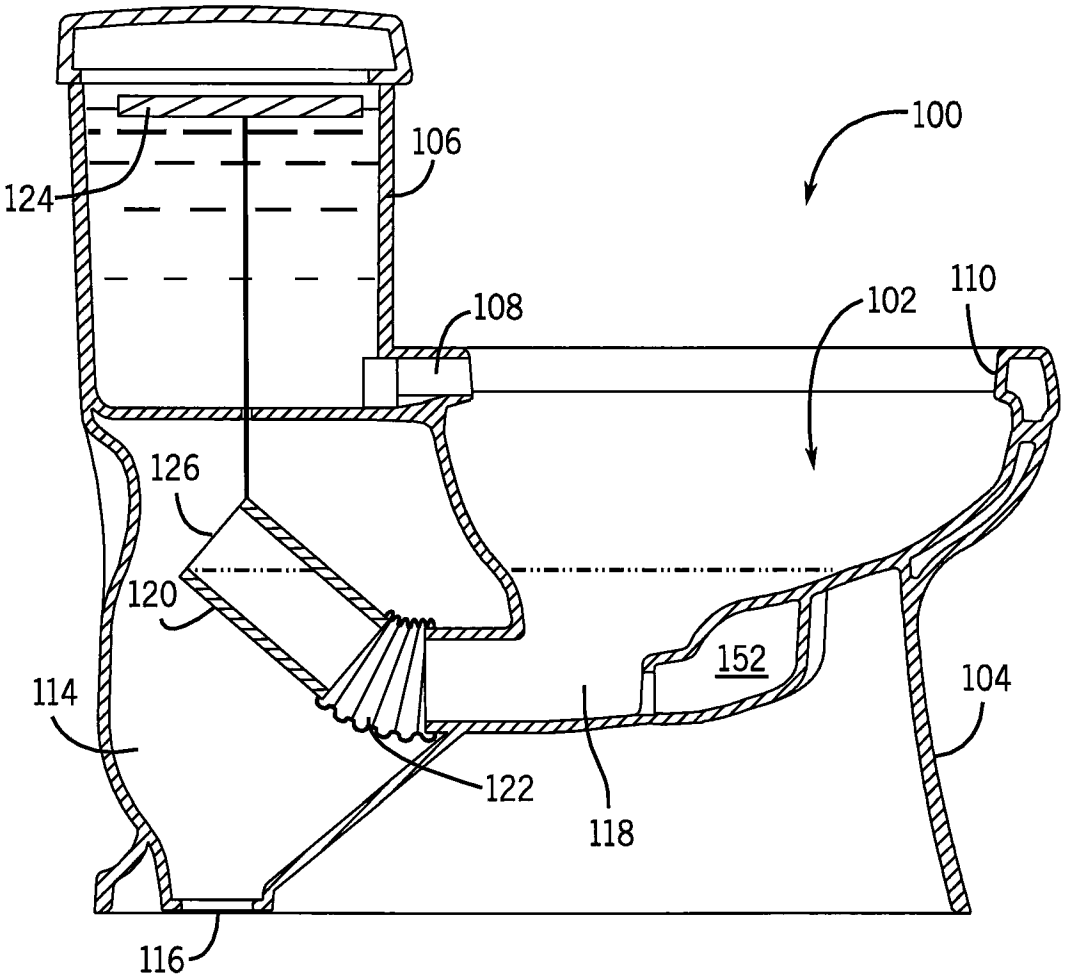
FIG. 2 is a view similar to FIG. 1, but of a first embodiment of the present invention, one that uses a float in the toilet tank to control the trap position.

In the FIG. 2/3 embodiment the water supply feeds the tank 106 in a conventional fashion. The tank 106 is placed in communication with the bowl 102 during the flushing cycle by virtue of a port 108 that delivers the water to a rim 110 around the upper outer periphery of the bowl 102. A conventional valve mechanism may be used to initiate and stop the transfer of water from the tank 106 to the bowl 102.

In the alternative embodiments of FIGS. 4-7, the water supply is a pressurized inlet line 112 that can be used to supply water to the bowl 102. An inline valve (not shown—e.g. a flushometer type valve) or other means of regulation may be used to regulate the flow of water to the bowl 102.

Referring back to FIGS. 2-3, the base 104 of the toilet 100 houses an outlet stack 114, which is a cavity within the base 104. The outlet stack 114 is below the tank 106 (or in the case of the FIG. 4-7 embodiments the inlet line 112) and behind the bowl 102. The outlet stack 114 has an outlet 116 near the bottom. The outlet 116 connects to a sewer waste line (not shown).

Adjacent a lower end of the bowl 102 there is an opening 118. A conduit 120 is linked to the opening 118 by a swivel joint 122. In preferred forms the conduit 120 is composed of a rigid material and the joint 122 is made of a flexible material. For example, the joint could be somewhat like a hospital straw.

In this way, the conduit 120, though rigid, can swivel so that its downstream can end can move between an upwardly directed position, and a downwardly directed position. See e.g. FIGS. 2, 4, and 6 as representing the first position, and FIGS. 3, 5, and 7 as representing the second position.

Figure 4:
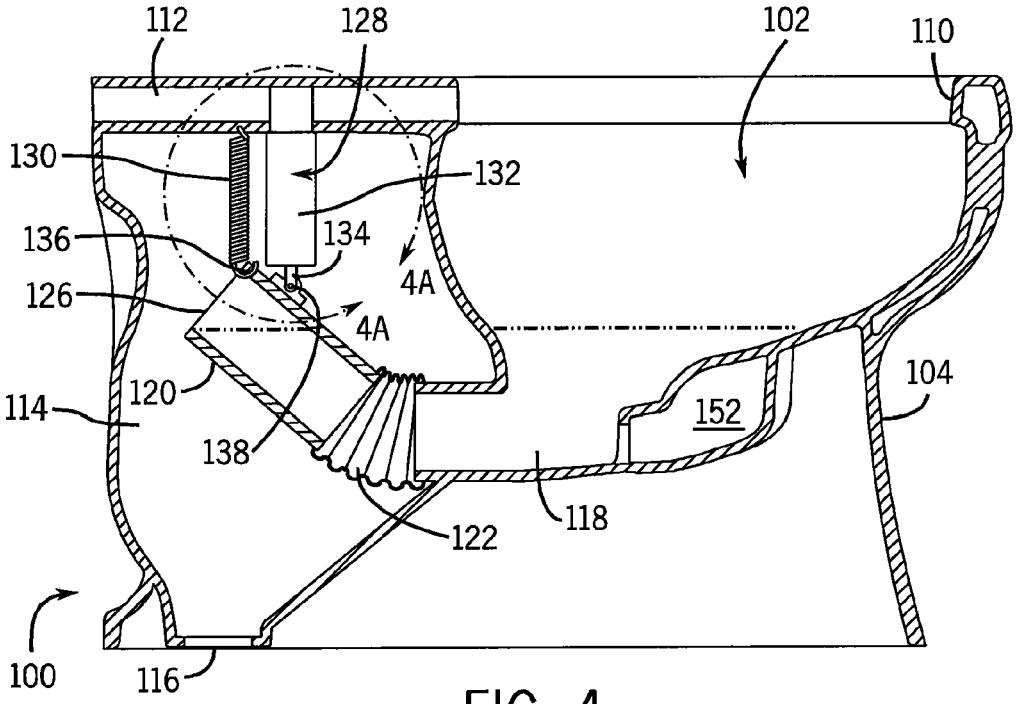
FIG. 4 is a view similar to FIG. 2, but of a second embodiment which uses a piston to drive the trap.
Figure 6:
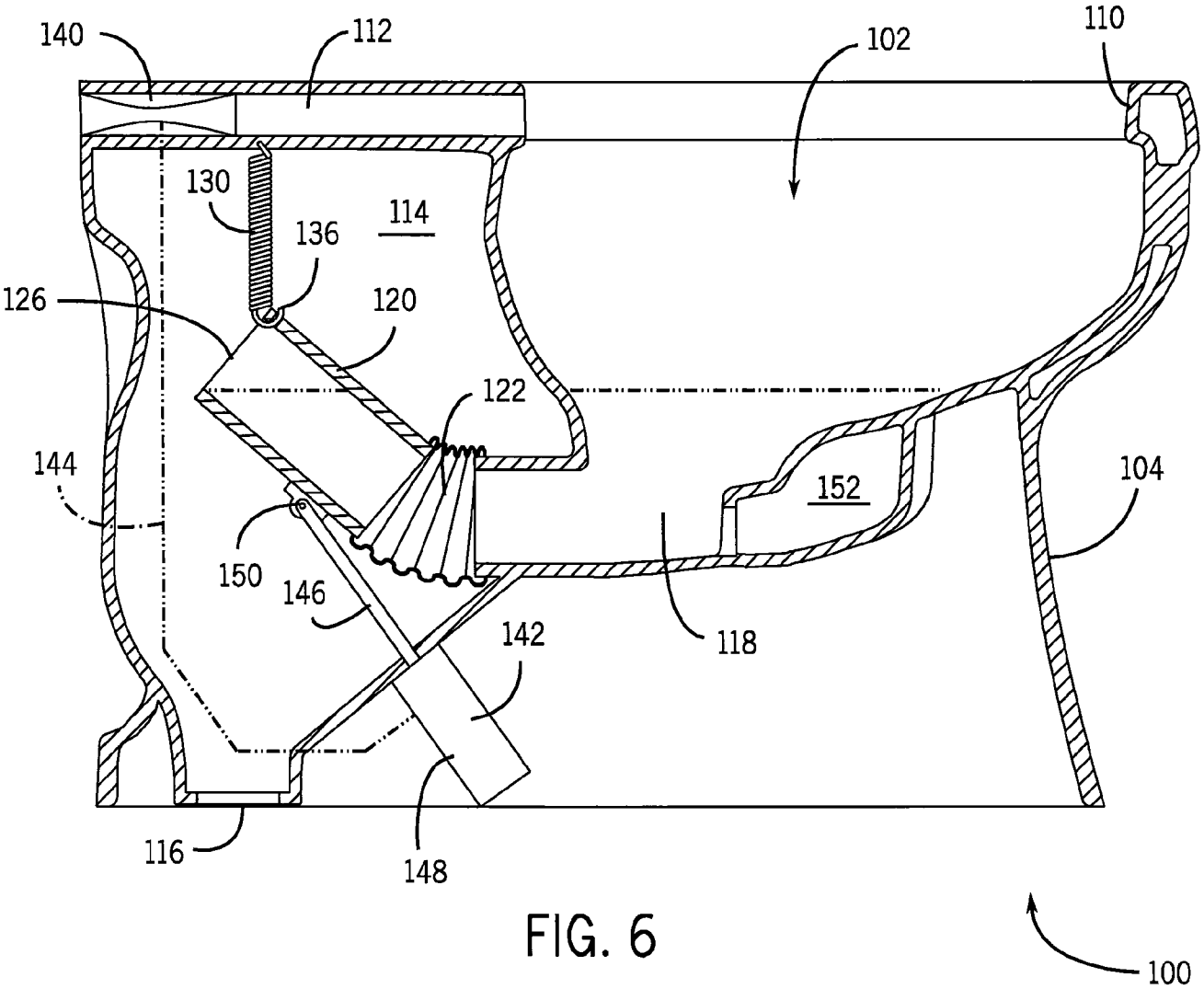
FIG. 6 is a view similar to FIG. 4, but of a third embodiment where suction pressure is used to cause a piston to move the trap.

The first/upwardly directed position creates a form of trap using the conduit 120. When the bowl 102 is filled with water as shown in FIGS. 2, 4, and 6, the water level in the bowl 102 and conduit 120 is such that a water seal is formed between the outlet stack 114 and the bowl 102.

The second less upwardly directed position of the conduit 120 facilitates the evacuation of the water and waste from the bowl 102. In this position, the waste and water from the bowl 102 are evacuated from the bowl 102, pass though the conduit 120 into the outlet stack 114, and are sent down the outlet 116 into the connected waste line. The second less upwardly directed position of the conduit 120 preferably is in at least a slightly downward direction, such that gravity can assist in the removal of the waste and water from the bowl 102.

The swiveling motion of the conduit 120 is controlled by one of three different actuator systems. These change the conduit position in response to a condition of a water supply for the toilet 100.

Figure 3:
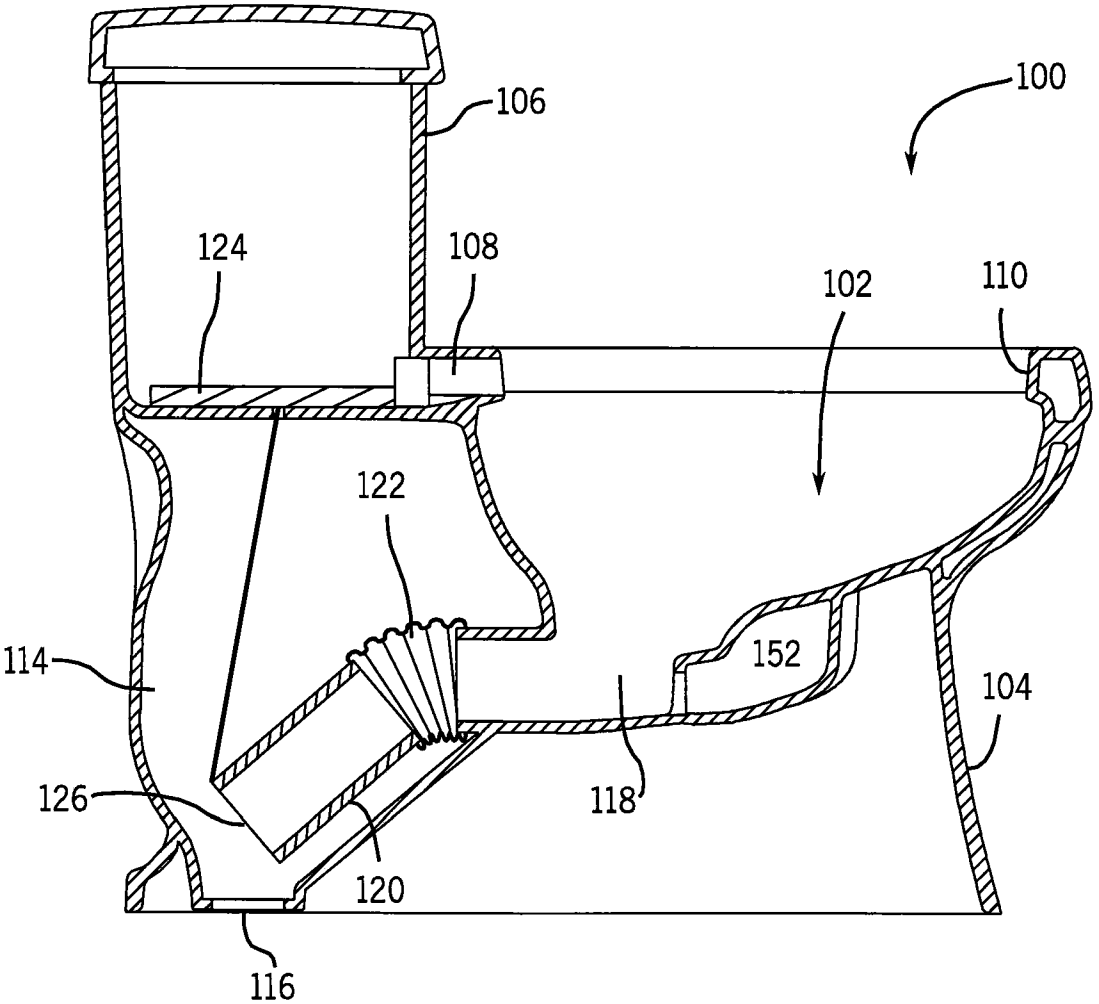
FIG. 3 is a view similar to FIG. 2, but showing the toilet at the point of the flush cycle where the tank water has completely emptied.

According to the shown in FIGS. 2 and 3, a float 124 in the tank 106 is mechanically linked to a downstream end 126 of the conduit 120 by a chain, cable, cord, or the like. As the water level in the tank 106 rises or falls, the float 124 follows, and raises or permits gravity to lower, the end of the conduit 120.

Thus, when the tank 106 is full, the float 124 is at a raised position in which it holds the conduit 120 in the first upwardly directed position such as is shown in FIG. 2. The float 124 is sufficiently buoyant such that the float 124 can hold the conduit 120 in the first position when the tank 106 has a level of water that is a normal fill level of the tank 106 (i.e., the tank 106 is at a steady state between flush cycles).

When water level in the tank 106 has during the flush cycle as the water in the tank 106 is used to fill and wash the bowl 102, the float 124 drops accordingly. As the float 124 drops, the conduit 120 to which it is mechanically linked also lowers to the second position as is shown in FIG. 3.

At this point, the waste and water from the bowl 102 are evacuated from the bowl 102 via the conduit 120 into the outlet stack 114. The waste and water fill a portion of the outlet stack 114 and are drained via the outlet 116 located proximate the bottom of the outlet stack 114. During this time, water may be continuously supplied to the bowl 102 to wash the bowl 102.

Notably, because the wash water does not play a role in the formation of a siphon, the wash water can be used in a manner that most efficiently washes the bowl 102. Typically, the wash pattern had to be selected such that it encouraged the formation or retention of a siphon. However, this restriction on the wash pattern has been eliminated with the kinetic trapway. For example, a vortex water delivery pattern may be delivered to the bowl 102 in a manner that would not be feasible in a siphonic toilet.

At the end of the flush cycle, as the tank 106 begins to refill with water, the float 124 will begin to rise with the water level in the tank. As the float 124 rises, the conduit 120 rises back to the first position to reform the water seal and assist with the retention of water in the bowl 102.

Figure 5:
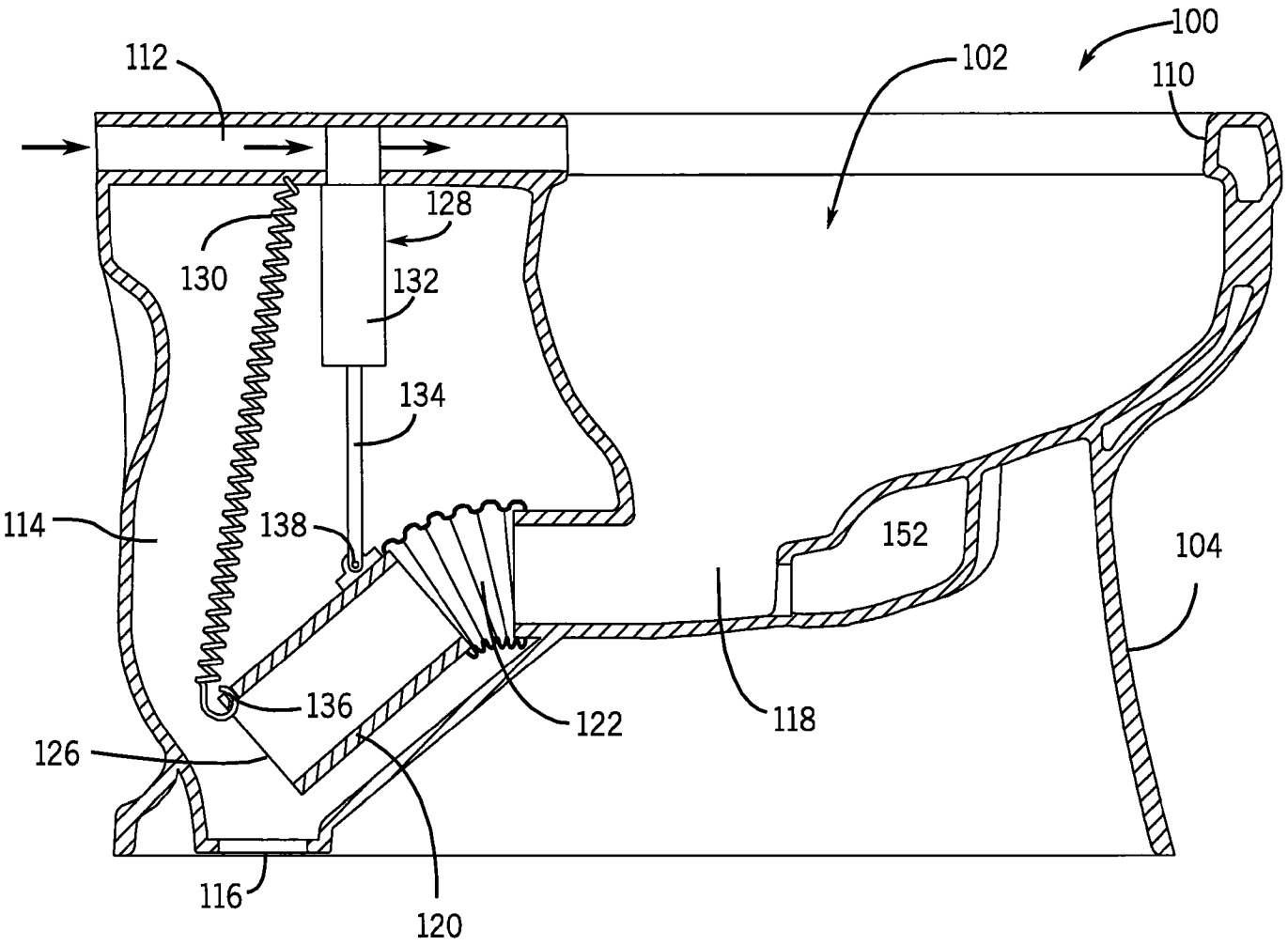
FIG. 5 is a view similar to FIG. 4, but showing the toilet during the flush cycle where line pressure from the inlet water has driven a trap downward notwithstanding return spring biasing force.

Referring now to the embodiment of FIGS. 4 and 5, according to another form of the actuator, the conduit 120 is controlled using a water cylinder 128 and a biasing spring 130. The water cylinder 128 includes a cylinder 132 and a piston 134. In this form, the toilet 100 has an inlet line 112, with an upstream valve that regulates the flow of water through the inlet line 112 to the bowl 102.

Figure 4A:
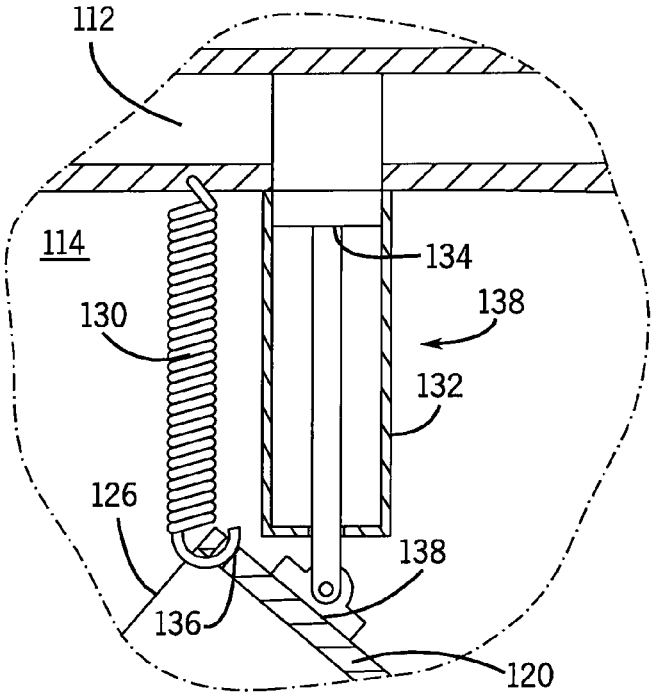
FIG. 4A is a detailed sectional view taken at region 4A-4A in FIG. 4.

Referring now to FIG. 4A, details of the biasing spring 130 and water cylinder 128 can be seen. The biasing spring 130 is attached to an upper surface of the outlet stack 114 and at a point 136 proximate the opening 118 of the conduit 120. The water cylinder 128 is in fluid communication with the inlet line 112 and is also connected to the conduit 120.

If the movement of the piston 134 relative to the cylinder 132 of the water cylinder 128 is linearly restricted, as is the case in many cylinders, it may be necessary to have the point of connection 138 between the end of the piston 134 and the conduit 120 be a dynamic joint. Such a joint may need to be hinged, linearly slidable, or both to accommodate for the structural limitations of the water cylinder 128.

When the piston 134 of the water cylinder 128 is in the "in" position, as is shown in FIGS. 4 and 4A, the biasing spring 130 applies a sufficient force to hold up the conduit 120 in the first position and maintain the water seal. When the piston 134 of the water cylinder 128 is in the "out" position, as is shown in FIG. 5, the conduit 120 is moved into the second less upwardly position when the force applied by the biasing spring 130 is overcome by the piston 134.

The piston 134 moves in response to the condition of the inlet line 112 (i.e., water supply). As the piston 134 is linked to the conduit 120, the movement of the piston 134 causes the movement of the conduit 120 between the first and the second positions. When water is sent through the inlet line 112 to the bowl 102 during the flush cycle, the increased water pressure in the inlet line 112 causes the piston 134 of the water cylinder 128 to move to the "out" position and move the water cylinder 128 to the second position against the force of the biasing spring 130.

Once the upstream valve is shut off (or partially shut) such that the inlet line 112 is less pressurized, the water cylinder 128 supplies an insufficient force to hold the conduit it in the second position against the biasing spring 130. With the force of the piston 134 removed, the biasing spring 130 lifts the conduit 120 back to the first position.

Figure 7:
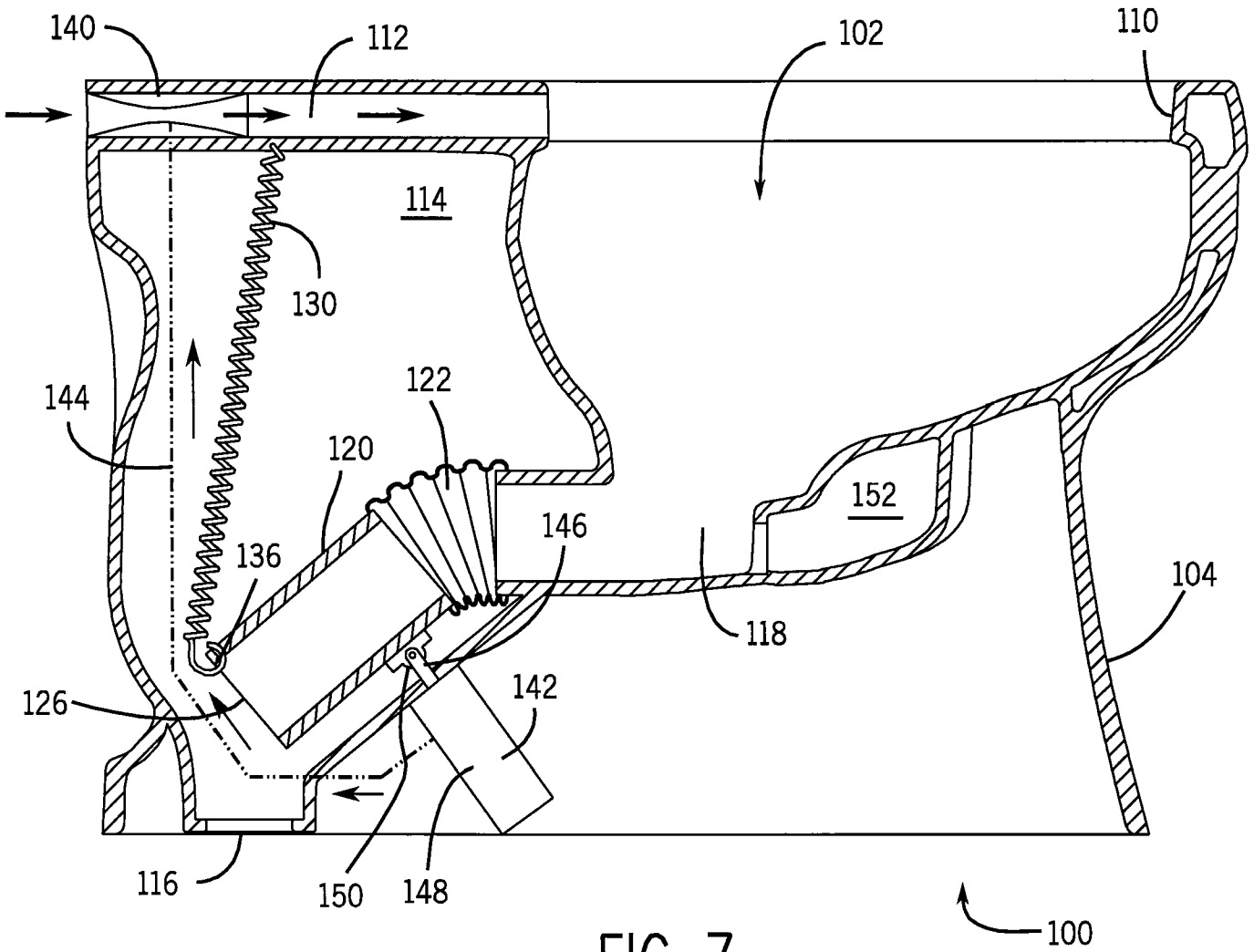
FIG. 7 is a view similar to FIG. 6, but showing the toilet during the flush cycle where line pressure from the inlet water has caused a suction which forces a piston to move the trap.

Referring now to FIGS. 6 and 7, and according to yet another form of the actuator, the toilet 100 further includes a venturi 140 in the inlet line 112. The venture 140 is in communication with an air cylinder 142 via an air line 144 (shown in dashes). Again, a biasing spring 130 is attached to the waterway to bias the conduit into the first position.

The air cylinder 142 includes a piston 146 in a cylinder 148. The air cylinder 142 is attached to the conduit 120 at a point of connection 150. This connection is made with respect to the same considerations made for the point of connection 138 in the water cylinder actuator described above.

As shown in FIG. 6, when the piston 146 of the air cylinder 142 is in the "out" position, the conduit 120 is located in the first position. As shown in FIG. 7, when the piston 146 of the air cylinder 142 is in the "in" position, the conduit 120 is located in the second position. Thus, per the illustrated configuration, when the toilet 100 is not in the midst of a flush cycle, the piston 146 is in the "out" position.

When water is supplied to the inlet line 112 during the flush cycle, the venturi 140 located therein forms a suction that is transmitted to the air cylinder 142 via the air line 144. This suction causes the piston 146 to move to the "in" position with sufficient force to lower the conduit 120 to the second position against the force of the biasing spring 130. The waste and water from the bowl 102 are emptied into the outlet stack 114 and down the outlet 116. When the flow of water through the inlet line 112 is reduced or stopped, then the venturi 140 stops providing sufficient suction to the piston 146 of the air cylinder 142 to hold the conduit 120 in the second position. The biasing spring 130 lifts to return the conduit 120 to the first position, where the water seal may be reformed. Correspondingly the piston 146 returns to the "out" position.

It should be appreciated that while the operation of the venturi 140 has been described with reference to the "in" position of the piston 146 corresponding to the second position of the conduit 120 and the "out" position of the piston corresponding to the first position of the conduit 120, that other configurations are possible. For example, the venturi 140 could be placed above the conduit 120 (akin to the positioning to the water cylinder 128) and configured such that the suction from the air line 144 moves the piston 146 to the out position. Likewise, the venturi 140 could provide an increase pressure zone adjacent the piston 146 to facilitate movement of the piston 146. This would be achieved by having the venturi 140 increase in cross-sectional area compared to the surrounding inlet line 112.

It should be noted that in all of the figures, that a jet 152 is shown. The inclusion of such the jet 152 is not required, but may be helpful in assisting to wash the waste from the conduit 120 during the flush cycle or in maintaining a sufficient amount of water in the outlet stack 114 to prevent the escape of sewer gases while the actuator returns the conduit 120 to the first position but before the water seal is formed.

Thus, the present invention provides a kinetic trapway that does not require the formation of a siphon for operation, and preferably does not require electricity to move the trapway. Many modifications and variations to these preferred embodiments will be apparent to those skilled in the art, which will be within the spirit and scope of the invention. Therefore, the invention should not be limited to just the described embodiments. To ascertain the full scope of the invention, the following claims should be referenced.

INDUSTRIAL APPLICABILITY

The invention provides toilets having moveable trapways for the efficient elimination of waste from a toilet bowl.

What is claimed is:

1. A toilet having an outlet trapway that is movable during a flushing cycle, the toilet comprising:

a toilet bowl having an opening adjacent its lower end;

a conduit linked to the opening so as to be able to swivel between a first upwardly directed position which forms a trap for the toilet, and a second less upwardly directed position which can be reached during the flushing cycle to facilitate evacuation of the toilet bowl;

an inlet line through which water enters the toilet bowl;

an actuator in open fluidic communication with the inlet line and linked to the conduit; and a biasing spring linked to the conduit;

wherein the actuator moves the conduit between the first and second positions when water is present in the inlet line;

wherein the actuator is actuated by a pressure change in the inlet line from water passing therethrough;

wherein the biasing spring and the actuator are linked to the conduit at different locations; and wherein the biasing spring acts on the conduit to bias the conduit toward the first position.

2. The toilet of claim 1, wherein the actuator includes a piston and a cylinder, the cylinder being in open fluidic communication with the inlet line and the piston being mechanically linked to the conduit, and wherein water passing through the pressurized inlet line forces the piston to move within the cylinder to thereby move the conduit.

3. The toilet of claim 2, wherein when the piston is extended, the conduit is moved to the second position.

4. The toilet of claim 1, wherein there is a flexible joint connecting the opening and the conduit.

5. The toilet of claim 4, further comprising an outlet stack positioned adjacent a downstream end of the conduit at least when the conduit is in the second position.

6. The toilet of claim 1, wherein the trapway is comprised of a rigid material.

7. The toilet of claim 1, wherein the biasing spring is coupled directly to the conduit.

8. The toilet of claim 1, wherein the biasing spring is coupled to an upper portion of the conduit.

9. The toilet of claim 1, wherein the biasing spring and the actuator act independently on the conduit.

10. The toilet of claim 1, wherein water is supplied to the inlet line from a source that is not a toilet tank.

11. A toilet comprising:

a bowl;

a water inlet line in fluidic communication with the bowl;

a conduit movably coupled to an opening of the bowl;

a spring coupled to the conduit and configured to bias the conduit in a normally elevated position; and an actuator coupled to the conduit and configured for moving the conduit to a lowered position;

wherein the spring and the actuator are coupled to the conduit at different locations;

wherein the actuator includes a piston and a cylinder, the cylinder being in open fluidic communication with the inlet line and the piston being mechanically linked to the conduit; and wherein water supplied to the inlet line causes movement of the piston within the cylinder to thereby move the conduit and flows to an upper portion of the bowl.

12. The toilet of claim 11, wherein an increase of water pressure in the inlet line occurs during a flush cycle, the increase of water pressure resulting in sufficient force in the actuator to cause the piston to extend from the cylinder to move the conduit to the lowered position.

13. The toilet of claim 12, wherein a decrease of water pressure occurs subsequent to the increase of water pressure, the decrease of water pressure resulting in insufficient force in the actuator to maintain the conduit in the lowered position.

14. The toilet of claim 11, wherein the toilet does not include a tank.

15. The toilet of claim 11, wherein the water supplied to the inlet line is supplied by a source that is not a toilet tank.

16. The toilet of claim 11, wherein the water causing movement of the piston flows directly from the inlet line into the bowl.

17. The toilet of claim 11, wherein the water causing movement of the piston subsequently flows from the inlet line into the bowl.

18. The toilet of claim 11, wherein when the piston is extended, the conduit is moved to the lowered position.

19. The toilet of claim 11, wherein the spring is coupled directly to the conduit.

20. The toilet of claim 11, wherein the spring and the actuator act independently on the conduit.

21. The toilet of claim 11, wherein the biasing spring is coupled to an upper portion of the conduit.

* * * * *